US012383000B1

(12) United States Patent
Motyl

(10) Patent No.: US 12,383,000 B1
(45) Date of Patent: Aug. 12, 2025

(54) KNEE PROTECTION SYSTEM AND METHOD OF USE

(71) Applicant: Jedidiah Motyl, Euless, TX (US)

(72) Inventor: Jedidiah Motyl, Euless, TX (US)

( * ) Notice: Subject to any disclaimer, the term of this patent is extended or adjusted under 35 U.S.C. 154(b) by 0 days.

(21) Appl. No.: 18/229,538

(22) Filed: Aug. 2, 2023

Related U.S. Application Data

(60) Provisional application No. 63/394,513, filed on Aug. 2, 2022.

(51) Int. Cl.
*A41D 13/06* (2006.01)
*A41D 13/015* (2006.01)

(52) U.S. Cl.
CPC ..... *A41D 13/065* (2013.01); *A41D 13/015* (2013.01); *A41D 13/06* (2013.01)

(58) Field of Classification Search
CPC ..... A41D 13/065; A41D 13/015; A41D 13/06
See application file for complete search history.

(56) References Cited

U.S. PATENT DOCUMENTS 356,502 A * 1/1887 Rauh ..... A41D 13/065 2/62
3,945,047 A * 3/1976 Jarrell, Jr. ..... A63B 71/1225 2/24
4,593,416 A * 6/1986 Figgie, III ..... A41D 13/065 2/24
4,692,946 A * 9/1987 Jurga ..... A63B 71/1225 2/22
5,594,954 A * 1/1997 Huang ..... A41D 13/065 2/24
5,611,080 A * 3/1997 Skottheim ..... A41D 13/0568 2/22
5,652,956 A * 8/1997 Hoshizaki ..... A63B 71/1225 2/22
5,711,029 A * 1/1998 Visco ..... A41D 13/065 2/24
6,178,555 B1 * 1/2001 Williams ..... A63B 71/1225 2/24
6,279,160 B1 * 8/2001 Chen ..... A41D 13/065 2/24
6,393,610 B1 * 5/2002 Parks ..... A63B 71/1225 2/22
6,553,572 B2 * 4/2003 Fiorini ..... A41D 13/065 2/22
6,964,062 B1 * 11/2005 Chen ..... A41D 13/065 2/22
7,114,189 B1 * 10/2006 Kleinert ..... A41D 13/065 2/24
10,231,860 B2 * 3/2019 Forbes ..... A61F 5/0109
2002/0162153 A1 * 11/2002 Collins ..... A41D 13/0568 2/22

(Continued)

FOREIGN PATENT DOCUMENTS

CA 3045998 A1 * 12/2020 ..... A41D 13/0543
CN 217242810 U * 8/2022

*Primary Examiner* — Khaled Annis
(74) *Attorney, Agent, or Firm* — Simpson & Simpson, PLLC

(57) ABSTRACT

A knee protection system has a lower guard that is strapped to the lower leg below the knee joint. An upper guard is attached to the lower guard by hinges so that when the knee bends the lower guard goes with it and the upper guard pivots to remain over the kneecap or thereabout.

8 Claims, 4 Drawing Sheets

(56) References Cited

U.S. PATENT DOCUMENTS

| | | | | |
|---|---|---|---|---|
| 2003/0019006 | A1* | 1/2003 | Godshaw | A41D 13/0568 2/24 |
| 2003/0024029 | A1* | 2/2003 | Fiorini | A41D 13/065 2/22 |
| 2005/0120454 | A1* | 6/2005 | Cunningham | A41D 13/0568 2/24 |
| 2005/0277859 | A1* | 12/2005 | Carlsmith | A61F 5/0125 602/20 |
| 2007/0192922 | A1* | 8/2007 | Dancyger | A41D 13/0568 2/24 |
| 2010/0192269 | A1* | 8/2010 | Saranga | A41D 13/0568 2/24 |
| 2012/0233736 | A1* | 9/2012 | Tepper | A41D 13/0153 2/24 |
| 2013/0025017 | A1* | 1/2013 | Chen | A63B 71/1225 2/22 |
| 2014/0189926 | A1* | 7/2014 | Gudalis | A63B 71/1225 2/24 |
| 2016/0213996 | A1* | 7/2016 | Hammer | A63B 71/1225 |
| 2022/0322764 | A1* | 10/2022 | Williams | A41D 13/0568 |

* cited by examiner

KNEE PROTECTION SYSTEM AND METHOD OF USE

BACKGROUND

1. Field of the Invention

The present invention relates generally to protective systems and methods, and more specifically, to a knee protection system that attaches the shine or calf of the person who wears so that the lower part remains fixed, and the upper part follows the upper leg so that both are protected while the person kneels.

2. Description of Related Art

Protective systems are well known in the art and are effective means to reduce or eliminate strain or injury to a person while they perform hazardous activities. Common protective systems include knee pads that attach a hard surface to the forward part of the knee. With the hard surface attached, when the person kneels the knee is kept from the floor or surface where the person kneels as the knee contacts the hard surface and it contacts the floor. The hard surface is commonly padded or contoured to further relieve pressure on the knee. Common knee pads are attached by straps or bands that pass around the upper leg, lower leg, or both. The hard surface could have vent holes, anti-slip coatings, or other minor improvements to alter the performance for a particular use or application One of the problems associated with common protective systems is their limited efficiency. For example, the hard surface is linear and only protects the part of the body that is behind it. When the person kneels the upper leg near the knee becomes exposed and therefore is susceptible to injury or harm.

Additionally, when the person moves the straps or the bands prevent natural movement and often fail to keep the hard protective surface over the knee and parts of the leg that it is supposed to protect.

Accordingly, although great strides have been made in the area of protective systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
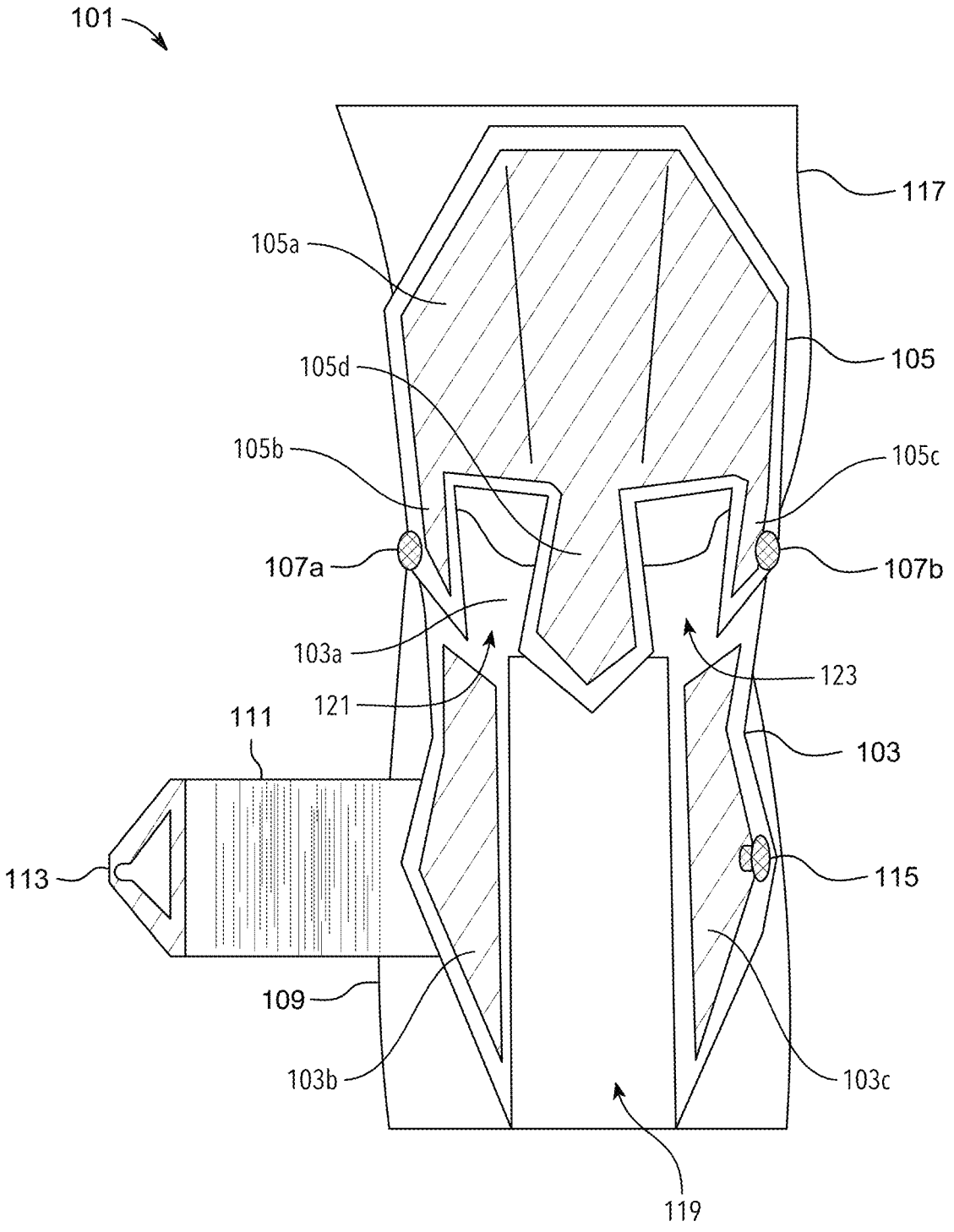
FIG. 1 is a front view of a knee protection system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional protective systems. Specifically, the present invention ensures the protective surfaces remain between the body and the direction of harm or threats thereto. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a front view of a knee protection system in accordance with a preferred embodiment of the present application. It will be appreciated that system 101 overcomes one or more of the above-listed problems commonly associated with conventional protective systems.

In the contemplated embodiment, system 101 includes a lower guard 103 pivotally attached to an upper guard 105 via hinges 107. A calf strap 111 is attached to lower guard 103 and is configured to wrap around the calf or upper lower leg 109 and secure to the opposite side via a buckle 113 and post 115. Lower guard 103 rests in front of the upper lower leg 109 and upper guard 105 rests in front of the lower upper leg 117 or knee.

As shown in FIG. 1, upper guard 105 has three sections that extend distally from a main section 105*a*, distal sections

105*b*, 105*c*, and 105*d*. Hinge 107*a* is disposed on distal section 105*b* and hinge 107*b* is disposed on distal section 105*c*. Distal section 105*d* extends further than distal sections 105*b* and 105*c* in a direction towards post 115 of lower guard 103. Space 121 is formed between distal section 105*b* and distal section 105*d*, and space 123 is formed between distal section 105*d* and distal section 105*c*.

As also shown in FIG. 1, lower guard 103 has two sections that extend distally from a main section 103*a*, distal sections 103*b* and 103*c*. Hinges 107*a* and 107*b* are disposed on main section 103*a*. Distal sections 103*b* and 103*c* extend away from main section 103*a*, where distal section 103*b* has strap 111 affixed thereto and distal section 103*c* has post 115 extending therefrom. Distal sections 103*b* and 103*c* form space 119 therebetween.

Figure 2:
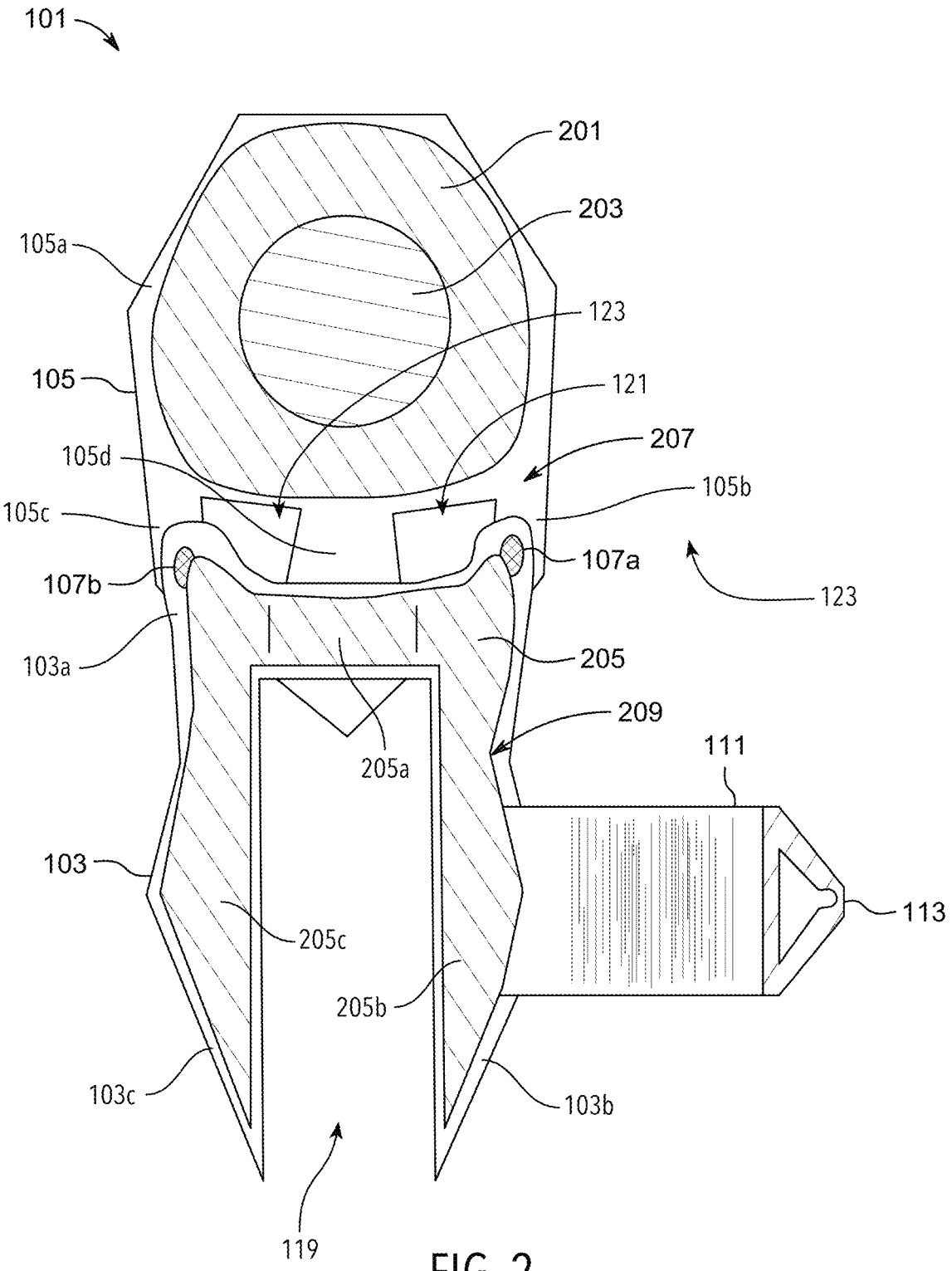
FIG. 2 is a back view of the system of FIG. 1.

Referring to FIG. 2, the interior of the system is shown. Upper guard 105 has a cushion ring attached to the interior surface 207 thereof. A bladder 203 is attached within cushion ring 201 and is configured to rest in front of the patella of the knee. Lower guard 103 has a pad 205 attached to the interior surface 209 thereof.

As shown in FIG. 2, pad 205 has corresponding sections to lower guard 103. Pad 205 generally includes a main section 205*a* that has two sections that extend distally from the main section 205*a*, distal sections 205*b* and 205*c*, that have space 205*d* therebetween.

In use, system 101 is attached to the leg of a person around the calf or upper lower leg 109. A first system is used for a first leg and a second system is used for a second leg. The use is similar for each leg so only one is discussed. Calf strap 111 is passed around upper lower leg 109 and fasted to post 115 via buckle 113 so that lower guard 103 is in front thereof and upper guard 105 is in front of the knee or lower upper leg 117. The person walks or kneels upper guard 105 pivots with respect to lower guard 103 via hinges 107. Pad 205 softens contact between upper lower leg 109 and the interior surface 209 of lower guard 103. Cushion ring 201 contacts the knee while bladder 203 provides impact protection to the knee.

It should be appreciated that one of the unique features believed characteristic of the present application is that upper guard 105 is not rigidly attached to lower guard 103 so that when the person bends their knee, upper guard 105 remains in front of the knee or lower upper leg 117 while lower guard 103 remains in front of upper lower leg 109. Hinges 107 (107*a* and 107*b*) allow upper guard 105 to pivot and therefore remain in a position to provide protection to the knee.

In reference to FIGS. 1 and 2, distal section 105*d* of upper guard 105 is arranged to extend past main section 103*a* of lower guard 103, such that it is over main section 103*a* of lower guard 103, thereby providing a stop to limit the rotational movement of hinges 107*a* and 107*b*.

Figure 3:
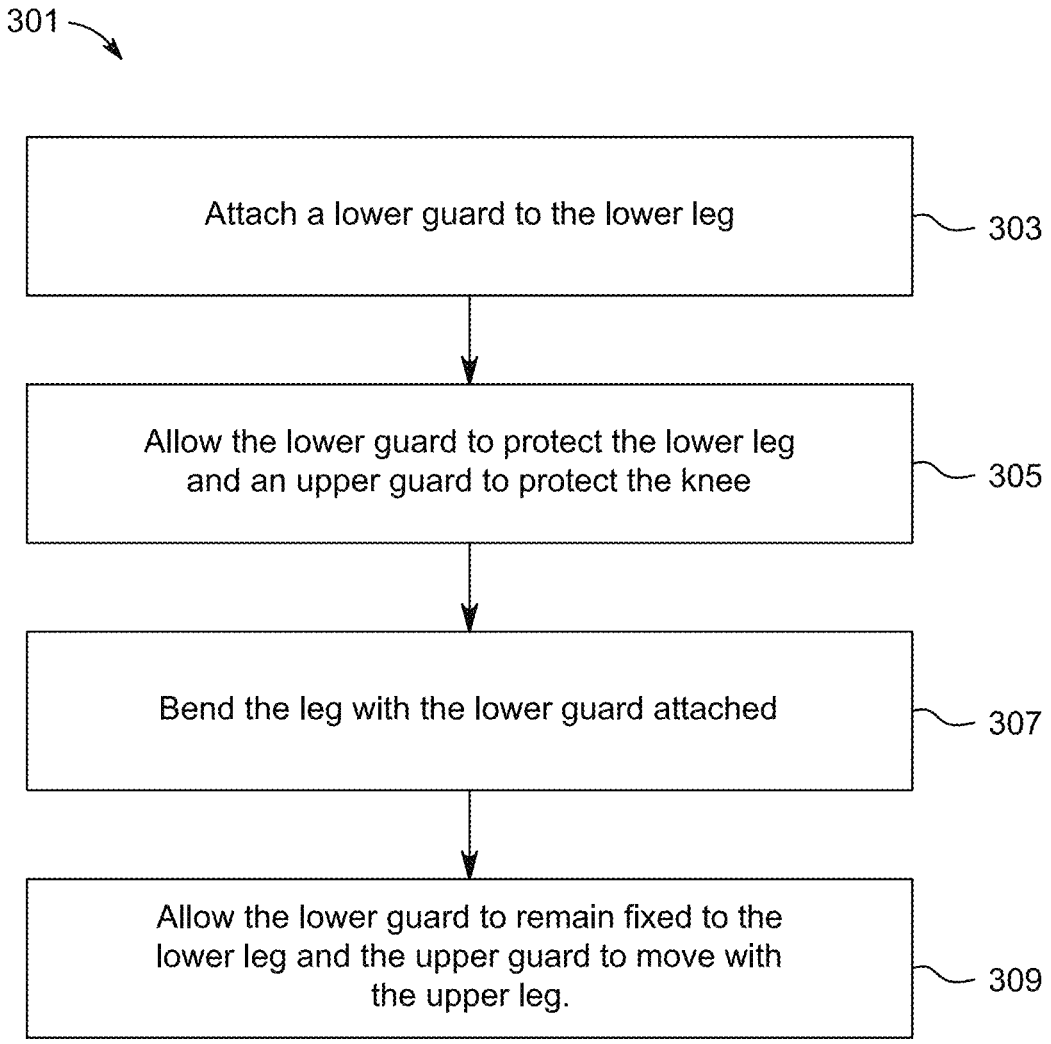
FIG. 3 is a flowchart of a method of protecting a knee.

Referring now to FIG. 3 a method of protecting a knee is depicted. Method 301 includes attaching a lower guard to the lower leg of a person 303, allowing the lower guard to protect the lower leg and the upper guard attached thereto to protect the knee 305, bending the leg with the lower guard attached 307, and allowing the lower guard to remain fixed to the lower leg and the upper guard to move with the upper leg 309.

Figure 4:
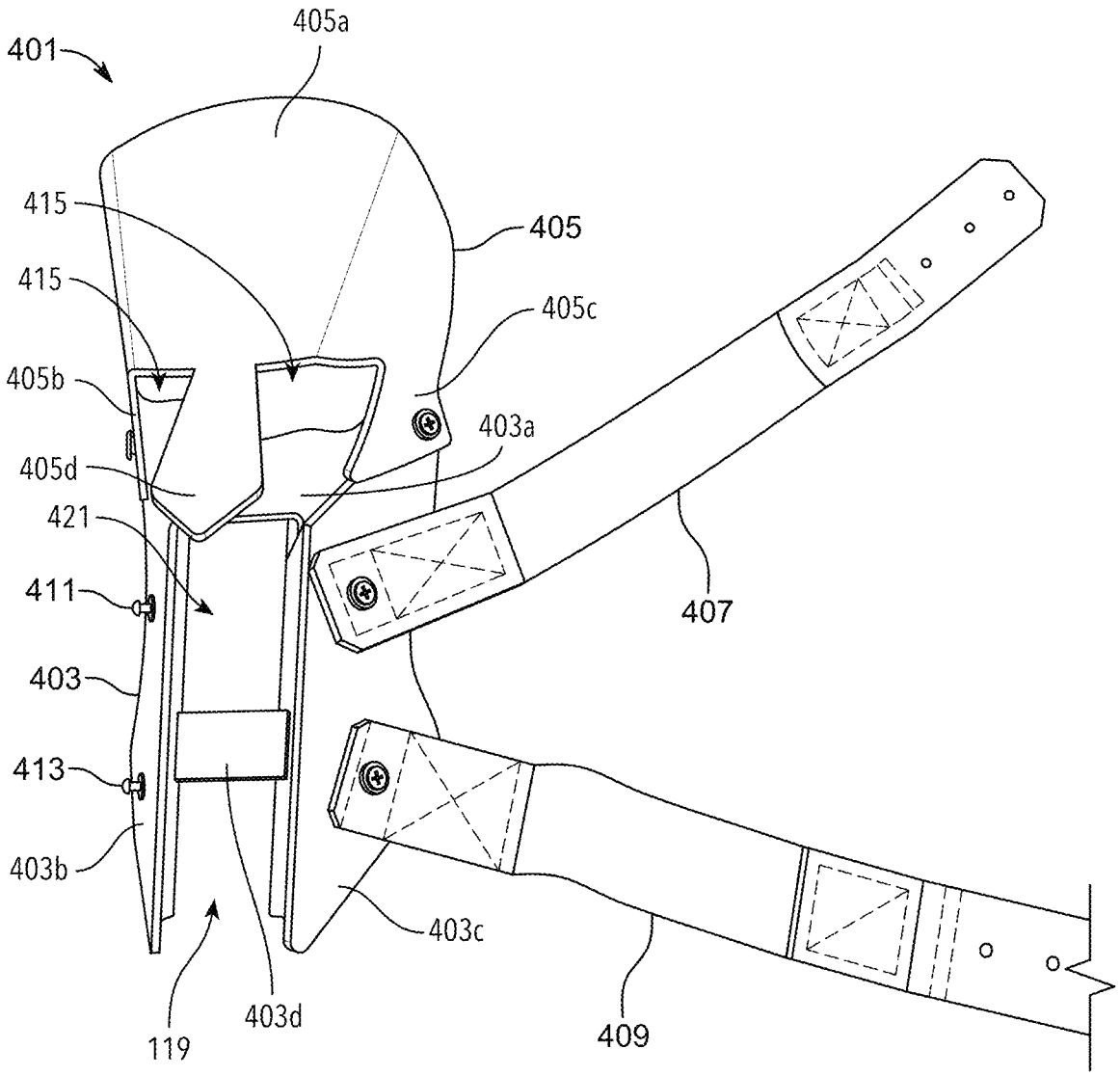
FIG. 4 is a front view of an alternative embodiment of the system of FIG. 1.

Referring to FIG. 4, an alternative embodiment of system 101 is depicted. Embodiment 401 includes a lower guard 403 pivotally attached to an upper guard 405. Lower guard 403 has an upper strap 407 that is configured to attach to an upper post 411 and a lower strap 409 that is configured to attach to a lower post 413. In this way the calf of the wearer is between upper strap 407 and lower strap 409.

The embodiment shown in FIG. 4 is similar to the embodiment shown in FIGS. 1 and 2, in that lower guard 403 has two sections that extend distally from a main section 403*a*, distal sections 403*b* and 403*c*. The hinges are disposed on main section 403*a*. Distal sections 403*b* and 403*c* extend away from main section 403*a*, where distal section 403*c* has straps 407 and 409 affixed thereto and distal section 403*b* has posts 411 and 413 extending therefrom. Distal sections 403*b* and 403*c* form spaces 419 and 421 therebetween, where the spaces are separated by connector 403*d* affixed to distal sections 403*b* and 403*c* and being proximate post 413.

Similarly, upper guard 405 has three sections that extend distally from a main section 405*a*, distal sections 405*b*, 405*c*, and 405*d*. The respective hinges disposed on distal section 405*b* and distal section 405*c*. Distal section 405*d* extends further than distal sections 405*b* and 405*c* in a direction towards post 411 of lower guard 403. Space 415 is formed between distal section 405*b* and distal section 405*d*, and space 417 is formed between distal section 405*d* and distal section 405*c*.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A knee protection system comprising:

a lower guard comprising a main section and a pair of distal sections extending from the main section, the distal sections forming a space therebetween;

a first pad attached to an interior surface of the lower guard, the first pad having a main section and a pair of distal sections extending from the main section, the distal sections of the pad forming a space therebetween;

an upper guard comprising a main section, a pair of outer distal sections extend distally from the main section and a middle distal section extending distally from the main section and past the pair of outer distal sections, each of the distal sections being spaced apart and forming a pair of spaces between;

a second pad attached to an interior surface of the upper guard;

a pair of hinges connected to each of the pair of outer distal sections and also connected to the main section of the lower guard, allowing the upper and lower guards to pivot about the pair of hinges;

at least one post extending from a first section of the pair of distal sections of the lower guard; and, at least one strap pivotably connected to a second section of the pair of distal sections of the lower guard, the at least one strap arranged to removably connect to the at least one post.

2. The system recited in claim 1, wherein the second pad is only attached to the main section of the upper guard.

3. The system recited in claim 1 further comprising:

a bladder attached to the second pad.

4. The system recited in claim 1, wherein the second pad comprises a cushion ring.

5. The system recited in claim 4 further comprising:

a bladder attached within the cushion ring.

6. The system recited in claim 1 further comprising:

a second post extending from the first section of the pair of distal sections of the lower guard; and, a second strap pivotably connected to the second section of the pair of distal sections of the lower guard, the second strap arranged to removably connect to the second post.

7. The system recited in claim 1 further comprising:

a connector connected to the pair of distal sections of the lower guard, the connector dividing the space formed by the pair of distal sections of the lower guard into an upper space and a lower space.

8. The system recited in claim 1 further comprising:

a buckle attached to the at least one strap, the buckle adapted to removably secure to the at least one post.

* * * * *